US012606285B2

(12) United States Patent
Serena et al.

(10) Patent No.: US 12,606,285 B2
(45) Date of Patent: Apr. 21, 2026

(54) UNMANNED UNDERWATER VEHICLE AND SYSTEM FOR THE MAINTENANCE AND INSPECTION OF UNDERWATER FACILITIES AND METHOD OF MANAGING A TETHER TO SUPPLY POWER AND TO CONTROL SAID UNDERWATER VEHICLE

(71) Applicant: SAIPEM S.P.A., Milan (IT)

(72) Inventors: Alberto Serena, Milan (IT); Giovanni Massari, Milan (IT); Diego Lazzarin, Milan (IT)

(73) Assignee: SAIPEM S.P.A., Milan (IT)

( * ) Notice: Subject to any disclaimer, the term of this patent is extended or adjusted under 35 U.S.C. 154(b) by 442 days.

(21) Appl. No.: 18/037,512

(22) PCT Filed: Nov. 23, 2021

(86) PCT No.: PCT/IB2021/060865
§ 371 (c)(1),
(2) Date: May 17, 2023

(87) PCT Pub. No.: WO2022/107107
PCT Pub. Date: May 27, 2022

(65) Prior Publication Data

US 2023/0415869 A1 Dec. 28, 2023

(30) Foreign Application Priority Data

Nov. 23, 2020 (IT) ..... 102020000028079

(51) Int. Cl.
*B63G 8/00* (2006.01)
*B63G 8/04* (2006.01)
*B63G 8/08* (2006.01)

(52) U.S. Cl.
CPC ..... *B63G 8/001* (2013.01); *B63G 8/04* (2013.01); *B63G 8/08* (2013.01); *B63G 2008/007* (2013.01)

(58) Field of Classification Search
CPC . B63G 8/001; B63G 8/04; B63G 8/08; B63G 2008/007
See application file for complete search history.

(56) References Cited

U.S. PATENT DOCUMENTS 3,168,261 A * 2/1965 Hainer ..... B65H 54/2866 242/397.2
6,167,831 B1 * 1/2001 Watt ..... E21B 41/04 114/322

(Continued)

FOREIGN PATENT DOCUMENTS

EP 0 883-009 A2 12/1998
KR 2014 0055571 A 5/2014

OTHER PUBLICATIONS

Notification Concerning Submission, Obtention or Transmittal of Priority Document for International Application No. PCT/IB2021/060865 dated Dec. 1, 2021.

(Continued)

*Primary Examiner* — Stephen P Avila
(74) *Attorney, Agent, or Firm* — Neal, Gerber & Eisenberg LLP

(57) ABSTRACT

An unmanned underwater vehicle for the maintenance and inspection of permanent underwater installations has a frame; a plurality of motorized thrusters directable to navigate in a body of water; a tether to supply power and control the underwater vehicle from a remote location; and a tether management device to selectively wind and unwind the tether on board the underwater vehicle.

15 Claims, 4 Drawing Sheets

(56) References Cited

U.S. PATENT DOCUMENTS

| | | | | |
|---|---|---|---|---|
| 6,390,012 | B1 * | 5/2002 | Watt | B63B 27/36 114/51 |
| 2007/0022935 | A1 | 2/2007 | Griffith et al. | |
| 2019/0084658 | A1 | 3/2019 | Bonel et al. | |

OTHER PUBLICATIONS

International Search Report and Written Opinion for International Application No. PCT/IB2021/060865 dated Feb. 11, 2022.

Aoki T et al: "Development of deep sea free swimming ROV "UROV7K"", Oceans '99 MIS/IEEE. Riding the Crest Into the 21st Century Seattle, WA, USA Sep. 13-16, 1999, Piscataway, NJ, USA & Washington, DC, US, US, vol. 3, Sep. 13, 1999 (Sep. 13, 1999), pp. 1307-1311, XP010354636, DOI: 10.1109/OCEANS.1999.800181, ISBN: 978-0-7803-5628-3, p. 1307, col. 2; figure 1.

Saudi Authority for Intellectual Property (SAIP) Examination Report No. 2 for Application No. 523440871 dated Jul. 28, 2025 (7 pages).

* cited by examiner

UNMANNED UNDERWATER VEHICLE AND SYSTEM FOR THE MAINTENANCE AND INSPECTION OF UNDERWATER FACILITIES AND METHOD OF MANAGING A TETHER TO SUPPLY POWER AND TO CONTROL SAID UNDERWATER VEHICLE

PRIORITY CLAIM

This application is a national stage application of PCT/IB2021/060865, filed on Nov. 23, 2021, which claims the benefit of and priority to Italian Patent Application No. 102020000028079, filed on Nov. 23, 2020, the entire contents of which are each incorporated by reference herein.

TECHNICAL FIELD

The present disclosure refers to an unmanned underwater vehicle and to a system for the maintenance and inspection of permanent underwater facilities.

Furthermore, the present disclosure relates to a method of managing a tether to supply power and control an underwater vehicle.

BACKGROUND

In the oil & gas sector, it is known to manufacture permanent underwater facilities comprising underwater infrastructures for the extraction and/or the production of hydrocarbons from wells made in the bed of a body of water. Within the scope of the present description, the term "permanent" means underwater facilities intended to operate on the bed of the body of water for an indefinite number of years. In the following description, "production of hydrocarbons" means one or more of the extraction of hydrocarbons, the treatment of hydrocarbons, the treatment of fluids correlated to the production of hydrocarbons and the subsequent transportation.

Underwater facilities for the production of hydrocarbons can be placed at or near subsea wells or in intermediate spots, and can assume different configurations on a bed of a body of water according to the well or to the field of wells. Furthermore, underwater facilities for the production of hydrocarbons can be positioned in relatively shallow waters or in relatively very deep waters and in all geographical areas regardless of the environmental conditions being relatively easy or extreme.

To summarize, an underwater facility for the production of hydrocarbons is part of a relatively complex facility which comprises an underwater facility for the production of hydrocarbons and pipes for the relative long-distance transportation between the underwater facilities and surface structures. The exploitation of oil and/or gas underwater reservoirs by underwater facilities for the production of hydrocarbons which provide for the extraction and the transportation of the hydrocarbon up to the surface or the coast have been implemented and an expansion is foreseeable in the upcoming future. The recent technological developments of the underwater devices suitable to operate at relatively great depths and the relative great interest of the oil companies have eased the feasibility of relatively complex systems, broadened the potentiality of the production underwater facilities and made possible any type of active process in water. The main processes of underwater treatment are generally: pumping or compression of the fluid; multiphase pumping; liquid/liquid separation; gas/liquid separation; solid/liquid separation; oil/water/gas separation; treatment and pumping; water treatment; heat exchange; and injection of water or gas in well.

Undoubtedly, underwater facilities for the production of hydrocarbons provide numerous advantages, however the relatively deeper the depth and/or the relatively larger the environmental context, the greater the criticalities are in the construction, the maintenance and the control of an underwater facility for the production of hydrocarbons.

Currently, the maintenance and inspection of the underwater facilities is carried out to a great extent by unmanned underwater vehicles of the ROV ("Remotely Operated Vehicle") type, each of which is connected to a surface station by a connection assembly, through which the underwater vehicle receives power and exchanges signals with the surface station.

The connection assembly generally comprises a tether connected at one end to the underwater vehicle; an intermediate station, which is arranged between the surface of the body of water and the bed of the body of water, is connected to the other end of the tether and comprises a tether management device configured to selectively wind and unwind the tether; and an umbilical, which vertically extends in the body of water and connects the surface station to the intermediate station.

During the maintenance and inspection operations of the underwater facilities, the shape that the tether assumes in the body of water is often unpredictable, because the tether is left slack and the tether is displaced by the effect of the currents present in the body of water and of the continuous shifts of the underwater vehicle itself.

Consequently, the position of the tether in the body of water is often uncontrollable and the risk of the tether remaining entangled between the structures of the underwater facilities is relatively high.

SUMMARY

The object of the present disclosure is to realize an underwater vehicle capable of overcoming certain of the drawbacks of certain of the known art.

In particular, an object of the present disclosure is to realize an underwater vehicle capable of freely displacing in the body of water simultaneously limiting the risk of the tether remaining entangled between the structures of the underwater facilities.

In accordance with the present disclosure, an unmanned underwater vehicle for the maintenance and inspection of permanent underwater installations is manufactured, the underwater vehicle comprising a frame; a plurality of motorized thrusters directable to navigate in a body of water; a tether to supply power and control the underwater vehicle from a remote location; and a tether management device to selectively wind and unwind the tether on board the underwater vehicle. In this manner, the tether management device is carried by the underwater vehicle and, consequently, it is possible to control on board of the underwater vehicle the unwinding of the tether along a designated or given path, remarkably limiting the risk of the tether remaining entangled in the structures of the underwater facilities.

More specifically, the tether management device comprises a tumbler for winding and unwinding the tether; and a pulley for selectively guiding the tether along the tumbler. In this manner, it is possible to wind and unwind the tether in a controlled manner.

In particular, the underwater vehicle comprises at least one power source; and a control unit. In this manner, when necessary, the underwater vehicle can operate as a vehicle of the AUV ("Automated Underwater Vehicle") type. In other words, the underwater vehicle can do without the supply and control tether.

In particular, the underwater vehicle comprises a first module comprising said directable motorized thrusters; said power source; and said control unit; and a second module comprising said tether and said tether management device, the first and the second modules being selectively couplable and decouplable in the body of water. In other words, the underwater vehicle is of modular type and can operate both as ROV and as AUV depending on the particular circumstances.

In particular, the first module comprises a compartment housing the second module, in particular the compartment is delimited at least by a bottom wall and two lateral walls, so as to enable the housing of the second module in the first module.

In particular, the first and the second modules comprise respective first and second guides configured to engage each other in sliding manner in a designated direction. In this manner, the coupling between the first and the second module is guided and can be carried out in a relatively simple and quick manner.

In particular, the first and the second modules comprise respective first and second mechanical connection elements to selectively engage the first module and the second module and release the second module from the first module.

Practically, the first and the second mechanical connection elements enable the mechanical connection between the first and the second module.

In particular, the first module and the second module comprise respectively first and second connectors for making an electrical power connection between the first and the second module and, in certain instances, a hydraulic connection and a signal connection between the first and the second module.

In particular, the first and the second modules comprise respective first and second floating bodies, so as to determine on the first and on the second modules respective buoyancies.

In particular, the tether has an average specific weight greater than the specific weight of the body of water in which the tether is immersed. In this manner, it is possible to keep the tether laying on the bed of the body of water along a designated path, preventing the tether from remaining suspended in the water and from being displaced in an uncontrolled and unpredictable manner by currents present in the body of water and by the continuous shifts of the underwater vehicle itself.

A further object of the present disclosure is to provide a system for the maintenance and inspection of underwater facilities which is exempt from certain of the drawbacks of certain of the known art.

In accordance with the present disclosure, a system for the maintenance and inspection of underwater facilities is provided, the system comprising at least one underwater vehicle as described herein; and at least one underwater resident station, the underwater vehicle and the underwater resident station being selectively couplable. In this manner, it is possible to house the underwater vehicle in the underwater resident station when the underwater vehicle is not operating.

In particular, the tether comprises an electrical power connector at one end selectively couplable to an electrical power connector of the underwater resident station, in particular said electrical power connectors are inductive connectors. In this manner, it is possible to transmit electrical power from the underwater resident station to the underwater vehicle through the tether.

In particular, the first module and the underwater resident station comprise respective third and fourth guides for making a sliding coupling between the first module and the underwater resident station in a designated direction. In this manner, the coupling between the first module and the underwater resident station is guided and can be carried out in a relatively simple and quick manner.

In particular, the second module and the underwater resident station comprise respectively third and fourth mechanical connection elements to selectively engage the second module to the underwater resident station and release the second module from the underwater resident station. In this manner, when necessary, the second module can be kept in the underwater resident station while the first module operates outside of the underwater resident station.

A further object of the present disclosure is to provide a method of managing a tether to supply power and control an underwater vehicle which is exempt from certain of the drawbacks of certain of the known art.

In accordance with the present disclosure, a method of managing a tether to supply power and control an underwater vehicle as previously described is provided, and comprising: moving the underwater vehicle into a body of water; controlling the path of the underwater vehicle from a remote station; and unwinding the tether from the underwater vehicle along a first path and laying the tether on a bed of the body of water. In accordance with the present method, it is possible to unwind the tether on the bed of the body of water controlling its path and consequently limiting the risk of the tether remaining entangled in the structures of the underwater facilities.

BRIEF DESCRIPTION OF THE DRAWINGS

Further characteristics and advantages of the present disclosure will be apparent from the following description of certain embodiments, with reference to the figures of the accompanying drawings, wherein.

DETAILED DESCRIPTION

Figure 1:
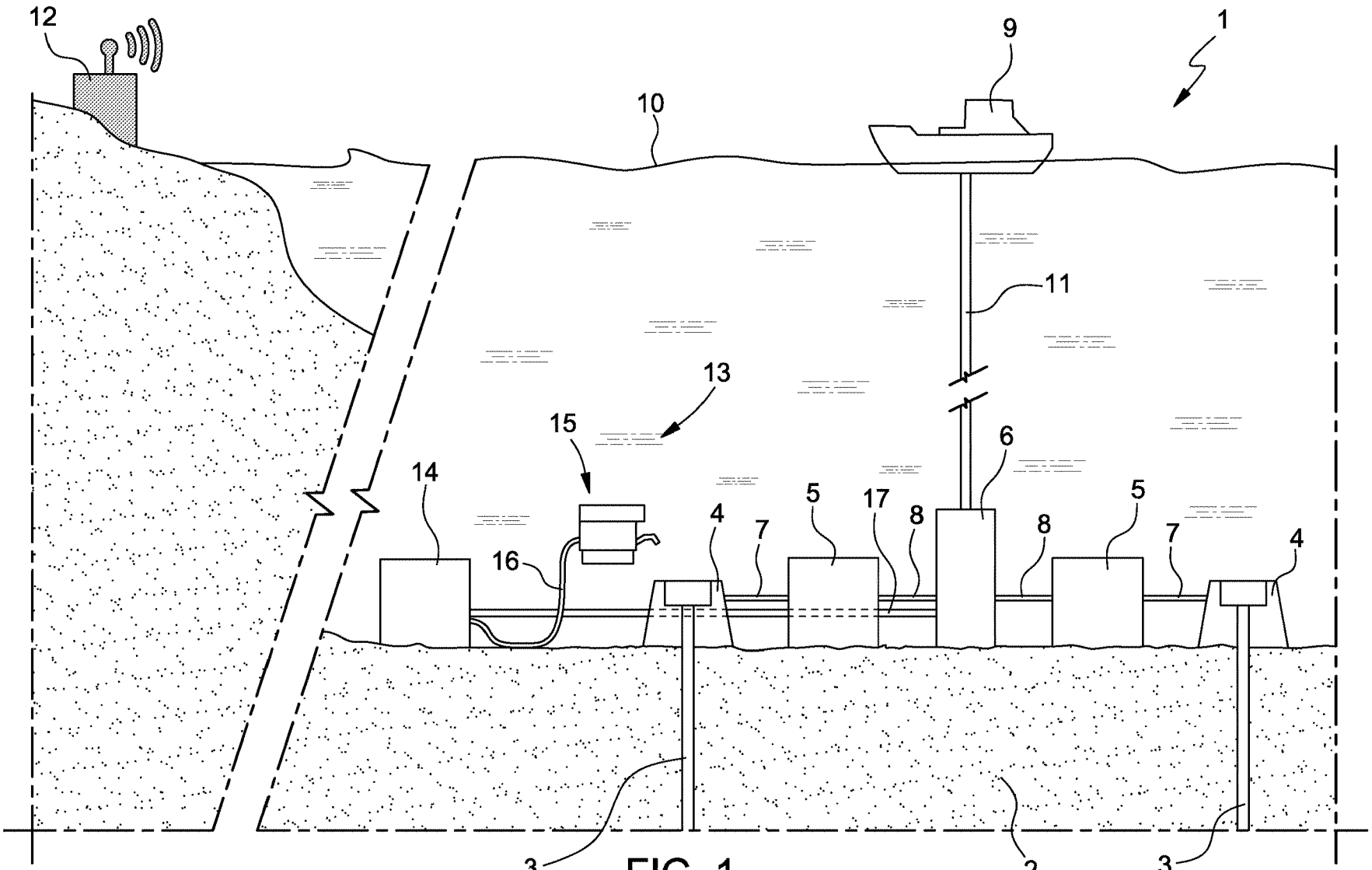
FIG. 1 is a schematic view in lateral elevation of an underwater facility for the treatment of hydrocarbons and of a system for the maintenance and inspection provided in accordance with the present disclosure and integrated with the underwater facility.

Reference numeral 1, in FIG. 1, indicates an underwater facility for the production of hydrocarbons. The facility 1 is arranged on a bed 2 of a body of water in proximity of a field of underwater wells 3 for the extraction of hydrocarbons from the bed 2 of the body of water (in this case, two underwater wells 3 are illustrated).

The facility 1 comprises a wellhead 4 for each underwater well 3, which is positioned on the bed 2 of the body of water at the respective well 3; a collector 5 for each wellhead 4; a processing underwater station 6; pipes 7, each of which is configured to hydraulically connect each wellhead 4 to the respective collector 5; pipes 8, each of which is configured to connect each connector 5 hydraulically, electrically and for the exchange of data to the processing underwater station 6; a surface station 9, which emerges at least partially from the surface 10 of the body of water; an umbilical 11, which enables the connection between the surface station 9 and the processing underwater station 6; and a land station 12, which is positioned on the dry land and is put in communication via radio with the surface station 9.

In particular, the umbilical 11 connects the surface station 9 and the processing underwater station 6, so as to enable the flow of fluid, the exchange of signals between the surface station 9 and the processing underwater station 6, and the transfer of power from the surface station 9 to the processing underwater station 6 so as to supply a control system and an electrical system (not shown in the figures).

According to alternative embodiments (not illustrated in the figures), the underwater facility 1 comprises for each wellhead 3, a Christmas tree coupled to a respective wellhead 4.

In the non-limiting case of the present disclosure described and illustrated, the surface station 9 is arranged on a watercraft. In accordance with an alternative embodiment (not shown), the surface station 9 is arranged on a floating platform.

The underwater facility 1 is integrated by a system 13 for the maintenance and inspection, which comprises an underwater resident station 14 arranged on the bed 2 of the body of water; and an unmanned underwater vehicle 15 provided with a tether 16, which is configured to supply power and control the underwater vehicle 15 and is selectively couplable to the underwater resident station 14.

In particular, the tether 16 has an average specific weight greater than the specific weight of the body of water in which the tether is immersed. In other words, the upward buoyance on the tether 16 is less than the downward weight force of the tether 16. For this reason, in use, the tether 16 lays on the bed 2 of the body of water.

The underwater resident station 14 has the function of housing the underwater vehicle 15 and of performing service operations on the underwater vehicle 15. The underwater resident station 14 is connected to the processing underwater station 6 by a tether 17 for the supply of power and for the transmission of data.

In accordance with an alternative embodiment (not shown in the figures), the underwater resident station 14 is connected to the surface station 9 by an umbilical.

Figure 2:
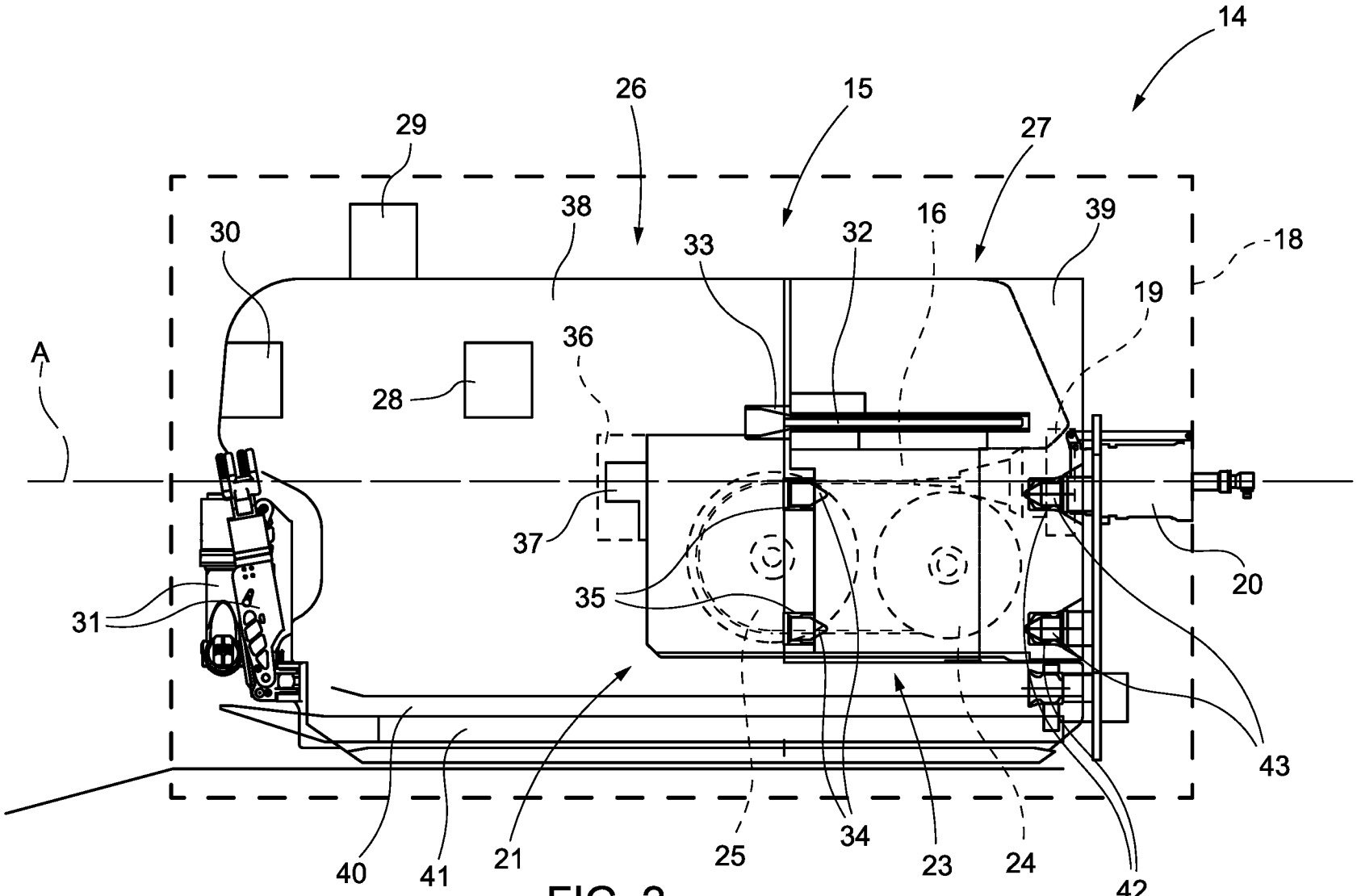
FIG. 2 is a view in lateral elevation, with parts removed for clarity and schematized parts, of an unmanned underwater vehicle manufactured in accordance with the present disclosure and part of the system for the maintenance and inspection of FIG. 1.
Figure 3:
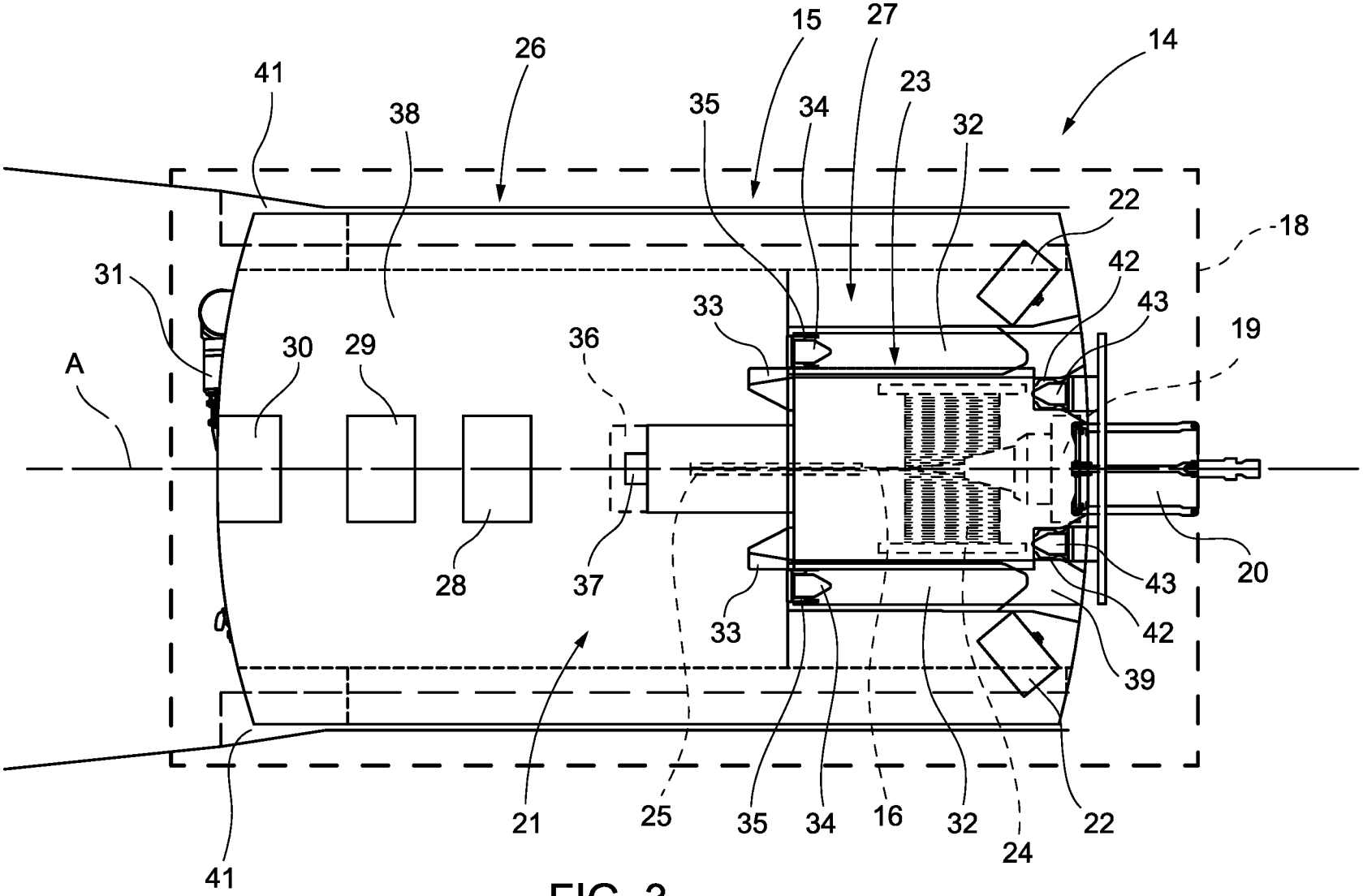
FIG. 3 is a plan view, with parts removed for clarity and parts schematized, of the unmanned underwater vehicle of FIG. 2 and part of the system for the maintenance and inspection of FIG. 1.
Figure 4:
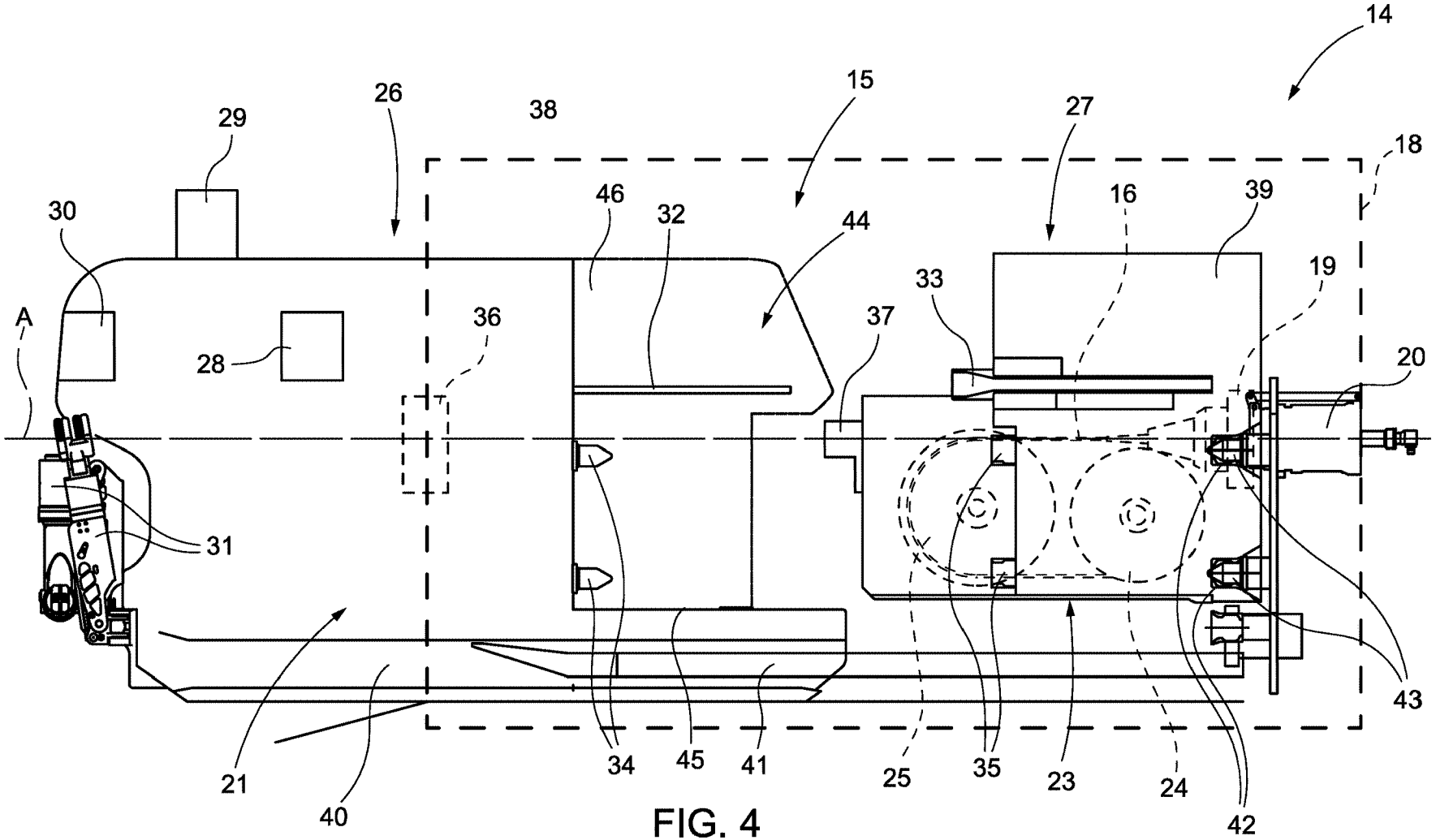
FIG. 4 is a view in lateral elevation, with parts removed for clarity and parts schematized, of the unmanned underwater vehicle of FIG. 2 in a further operating configuration and part of the system for the maintenance and inspection of FIG. 1.

With reference to FIGS. 2 to 4, the underwater resident station 14 is configured to define the shelter of the underwater vehicle 15. In particular, the underwater resident station 14 has parking stations 18, which are also configured to recharge the underwater vehicle 15. In an embodiment (not illustrated), the parking stations 18 may be arranged in various points of the underwater facility 1.

The underwater resident station 14 is capable of communicating with the underwater vehicle 15 both in tether mode (based on the tether 16 selectively couplable to the parking station 18), and in wireless mode. The wireless communications are of hybrid type and comprise acoustic, optical and electromagnetic communications.

In particular, the tether 16 comprises an electrical power connector 19 at an end selectively couplable to an electrical power connector 20 arranged in each parking station 18. More specifically, the electrical power connectors 19 and 20 are inductive connectors.

Furthermore, the tether 16 comprises a first connector for the exchange of signals, (not shown) which is selectively couplable to a second connector for the exchange of signals (not shown) arranged in each parking station 18.

The underwater vehicle 15 has a longitudinal axis A and comprises a frame 21; a plurality of motorized thrusters 22 (FIG. 3) directable to navigate in the body of water; and a tether management device 23 to selectively wind and unwind the tether 16 on board the underwater vehicle 15.

In the non-limiting case of the present disclosure described and illustrated, the tether management device 23 comprises a tumbler 24 to wind and unwind the tether 16; and a pulley 25 to selectively guide the tether 16 along the tumbler 24. In particular, the tumbler 24 and the pulley 25 are motorized, so as to enable the unwinding and the winding of the tether 16 and control the pull of the tether 16.

In the non-limiting case of the present disclosure described and illustrated, the underwater vehicle 15 comprises a module 26 and a module 27 selectively couplable to each other.

Practically, the module 26 and the module 27 are selectively couplable and decouplable in the body of water.

In particular, the module 26 comprises the thrusters 22 (FIG. 3); a power source 28, which comprises batteries (not shown in the figures); a control unit 29 configured to exchange data with the underwater resident station 14 and to control the modules 26 and 27; a navigation sensor assembly 30; and tools 31 configured to carry out maintenance operations of the underwater facility 1. The module 27 comprises the tether 16 and the tether management device 23.

The module 26 is configured to navigate in autonomous manner in the body of water and to communicate in wireless mode with the underwater resident station 14 and/or with the surface station 9 when the module 26 is decoupled from the module 27. In such a configuration, the module 26 is configured to operate in AUV mode (i.e., without the module 26 being connected to a tether configured to supply power and exchange of data). In particular, the power source 28 is configured to provide an electric energy reserve when the module 26 is decoupled from the module 27.

The control unit 29 is configured to exchange data in wireless mode with the underwater resident station 14 and/or with the surface station 9 when the control module 26 is decoupled from the module 27.

With the purpose of allowing or enabling the coupling of the module 27 with the module 26, the modules 26 and 27 comprise respective guides 32 and 33 configured to engage each other in sliding manner in a designated or given direction, in particular in a direction substantially parallel to the longitudinal axis A.

Furthermore, the modules 26 and 27 comprise respective mechanical connection elements 34 and 35 to selectively engage the module 26 and the module 27 and release the module 26 from the module 27; and respective connectors 36 and 37 to make an electrical power connection between the module 26 and the module 27 and, in certain instances, a hydraulic connection and a signal connection between the module 26 and the module 27.

Additionally, the modules 26 and 27 comprise respective floating bodies 38 and 39 to determine a buoyance respectively on the module 26 and on the module 27.

The module 26 and the underwater resident station 14 comprise respective guides 40 and 41 to make a sliding coupling between the module 26 and the underwater resident station 14 in a designated or given direction, in particular in a direction substantially parallel to the longitudinal axis A.

In accordance with alternative embodiments (not shown in the figures), the coupling between the module 26 and the underwater station 14 can be made according to further configurations. By way of example, the module 26 can make with the underwater station 14 a sliding coupling in a direction transverse to the longitudinal axis A and without the aid of guides.

Furthermore, the module 27 and the underwater resident station 14 comprise respective mechanical connection elements 42 and 43 to selectively engage the module 27 to the underwater resident station 14 and release the module 27 from the underwater resident station 14.

With reference to FIG. 4, the module 26 comprises a compartment 44 housing the module 27, in particular the compartment 44 is delimited at least by a bottom wall 45 and two lateral walls 46, only one of which is shown in FIG. 4.

In use and with reference to FIG. 1, when the maintenance and inspection of the components of the underwater facility 1 is required, the land station 12 communicates via radio with the surface station 9, which in turn communicates with the processing underwater station 6 through the umbilical 11. The communication is transmitted to the underwater resident station 14 through the tether 17 and the underwater vehicle 15 communicates through the tether 16 with the underwater resident station 14.

Depending on the particular operational needs, the underwater vehicle 15 can operate both in AUV mode, in which the module 26 is decoupled from the module 27 (FIG. 4), and in ROV mode, in which the module 26 is coupled to the module 27 (FIGS. 2 and 3).

The coupling and the decoupling between the module 26 and the module 27 occur inside the underwater resident station 14. In particular, when the module 26 and the module 27 are decoupled, the module 27 remains housed inside the underwater resident station 14.

When the module 26 is decoupled from the module 27, the module 26 navigates in autonomous manner in the body of water and communicates in wireless mode with the underwater resident station 14 and/or with the surface station 9, without the need to be connected to a tether for the supply of power and for the exchange of data.

Furthermore, the underwater vehicle 15 can operate in AUV mode also keeping the module 27 coupled to the module 26. In such configuration, the electrical power connector 19 is disconnected from the electrical power connector 20 and, consequently, the unwinding of the tether 16 is not carried out.

With reference to FIGS. 2 and 3, in the case when the underwater vehicle 15 operates in ROV mode, the electrical power connector 19 is connected to an electrical power connector 20 of the underwater resident station 14, and the mechanical connection elements 42 of the module 27 are disengaged from the respective mechanical connection elements 43 of the underwater resident station 14 to release the module 27 from the underwater resident station 14.

The motorized thrusters 22 (FIG. 3) cause the moving of the underwater vehicle 15 into the body of water, controlling the path of the underwater vehicle 15. Simultaneously, the tumbler 24 and the pulley 25 actuate the controlled unwinding of the tether 16, which lays on the bed 2 of the body of water along the path of the underwater vehicle 15, due to the tether 16 having an average specific weight greater than the specific weight of the body of water in which the tether is immersed.

When the underwater vehicle 15 has to be brought back to the underwater resident station 14, the underwater vehicle 15 moves along a return path according to the position of the tether 16 laid on the bed 2 of the body of water. Simultaneously, the tumbler 24 and the pulley 25 actuate the winding of the tether 16.

In case of malfunction of the module 27, the module 26 is released from the malfunctioning module 27 and couples to a further module 27 housed in a further parking station 18.

In the described example, the system for the maintenance and inspection is associated to an underwater facility for the production of hydrocarbons, it being understood that the claimed vehicle and system can find other applications in the underwater field. Furthermore, the system can comprise more than one unmanned vehicle and/or several base stations and the number of unmanned underwater vehicles and base stations depends on the dimensions and on the relative complexity of the facility.

Finally, it is apparent that variants can be made to the present disclosure with respect to the embodiments described with reference to the accompanying figures without thereby departing from the scope of protection of the claims. That is, the present disclosure also covers embodiments that are not described in the detailed description above as well as equivalent embodiments that are part of the scope of protection set forth in the claims. Accordingly, various changes and modifications to the presently disclosed embodiments will be apparent to those skilled in the art.

The invention claimed is:

1. An unmanned underwater vehicle configured to maintain and inspect a permanent underwater installation, the unmanned underwater vehicle comprising:

a frame;

a plurality of motorized thrusters directable to navigate in a body of water;

a tether configured to supply power to and send control signals to the unmanned underwater vehicle from a remote location;

a tether management device configured to selectively wind and unwind the tether on board the unmanned underwater vehicle;

a first module comprising the plurality of motorized thrusters, a power source of the unmanned underwater vehicle and a control unit of the unmanned underwater vehicle; and a second module comprising the tether and the tether management device, wherein the first module and the second module are selectively couplable and decouplable in the body of water.

2. The unmanned underwater vehicle of claim 1, wherein the tether management device comprises:

a tumbler configured to wind and unwind the tether, and a pulley configured to selectively guide the tether along the tumbler.

3. The unmanned underwater vehicle of claim 1, wherein the first module comprises a compartment configured to house the second module, the compartment being delimited by at least a bottom wall and two lateral walls.

4. The unmanned underwater vehicle of claim 1, wherein the first module and the second modules comprise respective guides configured to slidably engage each other in a designated direction.

5. The unmanned underwater vehicle of claim 1, wherein the first module and the second module comprise respective mechanical connection elements configured to: (i) selectively engage the first module and second module, and (ii) selectively release the second module from the first module.

6. The unmanned underwater vehicle of claim 1, wherein the first module and the second module comprise respective connectors configured to establish at least an electrical power connection between the first module and the second module.

7. The unmanned underwater vehicle of claim 1, wherein the first module and the second module comprise respective connectors configured to establish at least one of a hydraulic connection between the first module and the second module and a signal connection between the first module and the second module.

8. The unmanned underwater vehicle of claim 1, wherein the first module and the second module comprise respective floating bodies.

9. The unmanned underwater vehicle of claim 1, wherein the tether has an average specific weight greater than a specific weight of the body of water in which the tether is immersed.

10. An underwater facility maintenance and inspection system comprising:

an unmanned underwater vehicle comprising:

a frame, a plurality of motorized thrusters directable to navigate in a body of water;

a tether configured to supply power to and send control signals to the unmanned underwater vehicle from a remote location, a tether management device configured to selectively wind and unwind the tether on board the unmanned underwater vehicle, a first module comprising the plurality of motorized thrusters, a power source of the unmanned underwater vehicle and a control unit of the unmanned underwater vehicle, and a second module comprising the tether and the tether management device, wherein the first module and the second module are selectively couplable and decouplable in the body of water; and an underwater resident station selectively couplable with the unmanned underwater vehicle.

11. The underwater facility maintenance and inspection system of claim 10, wherein the tether comprises an electrical power connector at one end selectively couplable with an electrical power connector of the underwater resident station.

12. The underwater facility maintenance and inspection system of claim 10, wherein the first module and the underwater resident station comprise respective guides to form a sliding coupling between the first module and the underwater resident station in a designated direction.

13. The underwater facility maintenance and inspection system of claim 12, wherein the second module and the underwater resident station comprise respective mechanical connection elements configured to selectively engage the second module to the underwater resident station and selectively release the second module from the underwater resident station.

14. A method of managing a tether of an unmanned underwater vehicle, the method comprising:

moving the unmanned underwater vehicle into a body of water, the unmanned underwater vehicle comprising a frame, a plurality of motorized thrusters directable to navigate in the body of water, the tether configured to supply power to and send control signals to the unmanned underwater vehicle, a tether management device, a first module comprising the plurality of motorized thrusters, a power source of the unmanned underwater vehicle and a control unit of the unmanned underwater vehicle, and a second module comprising the tether and the tether management device, wherein the first module and the second module are selectively couplable and decouplable in the body of water;

controlling the path of the unmanned underwater vehicle from a remote station;

unwinding the tether from the unmanned underwater vehicle along a first path; and laying the tether on a bed of the body of water.

15. The method of claim 14, further comprising winding the tether in the unmanned underwater vehicle according to a position of the tether along a second path.

* * * * *